US009486016B2

(12) United States Patent
Cataldo

(10) Patent No.: US 9,486,016 B2
(45) Date of Patent: Nov. 8, 2016

(54) MODESTY BRA FOR PORT UNDER CLAVICLE

(71) Applicant: Jill Cataldo, Wildwood Crest, NJ (US)

(72) Inventor: Jill Cataldo, Wildwood Crest, NJ (US)

( * ) Notice: Subject to any disclaimer, the term of this patent is extended or adjusted under 35 U.S.C. 154(b) by 0 days.

(21) Appl. No.: 15/070,782

(22) Filed: Mar. 15, 2016

(65) Prior Publication Data

US 2016/0295929 A1 Oct. 13, 2016

Related U.S. Application Data

(60) Provisional application No. 62/146,328, filed on Apr. 12, 2015.

(51) Int. Cl.
*A41C 3/00* (2006.01)
*A47G 9/10* (2006.01)

(52) U.S. Cl.
CPC ..... *A41C 3/0064* (2013.01); *A41C 3/0035* (2013.01); *A47G 9/10* (2013.01)

(58) Field of Classification Search
CPC ..... A41C 3/04; A41C 5/0064; A41C 5/04; A41C 5/128; A41C 5/144
USPC ..... 450/36, 54–57, 89
See application file for complete search history.

(56) References Cited

U.S. PATENT DOCUMENTS

| | | | | |
|---|---|---|---|---|
| 2,925,816 | A * | 2/1960 | Rosenthal | A41C 3/04 450/37 |
| 4,699,144 | A * | 10/1987 | Sherwood | A41C 3/148 450/54 |
| 5,098,330 | A * | 3/1992 | Greenberg | A41C 3/10 450/31 |
| 7,081,034 | B1 * | 7/2006 | Zoellner | A41C 3/04 2/104 |
| 7,234,996 | B1 * | 6/2007 | Donker | A41C 3/0035 450/1 |
| 7,278,899 | B2 * | 10/2007 | Davis | A41C 3/065 450/38 |
| 7,585,200 | B1 * | 9/2009 | McLaren | A41C 3/0035 2/247 |
| 8,597,072 | B1 * | 12/2013 | Lucas | A41C 3/0035 2/247 |
| 2012/0129427 | A1 * | 5/2012 | Perez | A41C 3/04 450/36 |

* cited by examiner

*Primary Examiner* — Gloria Hale
(74) *Attorney, Agent, or Firm* — Michael J. Feigin, Esq.; Feigin & Fridman

(57) ABSTRACT

A bra with breast region has a strap extending over a shoulder to the breast region. An outer layer of the bra is fixedly attached to the breast region, but removably attached to the strap. A removable pillow is within this outer layer. The fixedly attached portion of the outer layer attached to the breast region extends from the breast region up to a pocket housed within the outer layer, the pocket, in turn, being adapted to house the pillow. Then upward, the outer layer is free from attachment to the inner layer, though it is removably attached to the strap at a top side.

13 Claims, 3 Drawing Sheets

MODESTY BRA FOR PORT UNDER CLAVICLE

FIELD OF THE DISCLOSED TECHNOLOGY

The disclosed technology relates generally to clothing, and, more specifically, to a type of bra for cancer patients and others.

BACKGROUND

Access to the veins is needed for chemotherapy, blood transfusions/samples, antibiotics, and/or intravenous (IV) fluids especially, during cancer treatment. A catheter or port is sometimes placed into the patient in a large vein under the clavicle (collarbone) or in the neck, and then tunneled under the skin. The other end of the catheter leaves the body through a separate exit point, usually in the upper chest, and the catheter is accessed from this exit site.

In the prior art, a patient typically takes off her clothing during such treatment, leaving her exposed. This is undesirable, especially at a time when the patient is feeling so vulnerable. What is needed is a way to make the required location available for a catheter or port, while maintaining coverage of the body and the patient's dignity.

SUMMARY OF EMBODIMENTS OF THE DISCLOSED TECHNOLOGY

A bra has an inner layer with cups and an outer layer, in embodiments of the disclosed technology. These layers are attached to each other at a lower side, but at the upper side, they are separate. When "lower" and "upper" are used in this disclosure, this refers to the typical orientation of the bra when worn by an upright-standing human. The upper side of the outer layer and the inner layer are separately attached to a strap. A pocket is disposed within the outer layer, having an opening on a side facing the inner layer, when the outer layer is attached to the strap and sits flush over the inner layer.

The pocket can be heart-shaped. A vertex (the point generally found at the bottom of a heart) faces towards the upper side (that is, the heart is "upside down" relative to the ground), and two convex regions (the top of the heart) thereof face towards the lower side, in embodiments of the disclosed technology. The pocket may be filled with a heart-shaped pillow. This pillow is oriented to match that of the pocket, in embodiments. A pillow, for purposes of this disclosure, is defined as a bag with sealed, or mostly sealed, outer shell holding there-within more compressible material. The outer shell can be fabric, and the inner compressible material can be feathers, foam, or the like.

The outer layer can also be substantially triangle-shaped. This outer layer is fixedly attached to the inner layer along edges of two convex regions of the pocket. The cups can be adapted to cover breasts, and the outer layer is adapted to extend partially within an area from the breasts to a shoulder.

Another way of describing the bra and pillow of embodiments of the disclosed technology is that the bra has a breast region. This region is adapted to cover breasts. A strap supports the breast region (and breasts) by extending over a shoulder. An outer layer of the bra is fixedly attached to the breast region, but removably attached to the strap. A removable pillow is within this outer layer. The fixedly-attached part extends from the breast region up to a pocket housed within the outer layer. From there upwards, the outer layer is free from attachment to the inner layer, though it is removably attached to the strap.

This line of delineation between the pocket and an edge of the fixedly attached connection between the outer layer and the breast region is defined, in some embodiments, by two convex bumps with a sharp vertex situated between each of the two convex bumps. This is in the shape of a top of a heart. As such, a heart-shaped pillow fits within this pocket, with the top bumps of the heart fitting in the downward-facing bumps of the pocket. The outer layer becomes narrower as one moves upward, fitting with the dimensions of the heart-shaped pillow in a similar manner.

One places the pillow in the pocket of the outer layer, by way of a portal on a side of the outer layer which faces towards the strap underneath the outer layer, in embodiments of the disclosed technology. This portal can extend a majority of a length of a portion of the outer layer, which is free from attachment to the breast region.

In a method of use of the bra and pillow, one wears or dons the bra with the pillow in the pocket. Then, when needed, such as when preparing for surgery, one disconnects the outer layer from the bra strap, while this outer layer remains connected to the breast region. The pillow is removed from the pocket, and one presses against the pillow (such as for comfort) by pressing the pillow with one's hands against one's chest, while undergoing a surgical procedure.

DETAILED DESCRIPTION OF EMBODIMENTS OF THE DISCLOSED TECHNOLOGY

For purposes of this disclosure, a "clavicle port" refers to a surgically produced opening between the clavicle (collar bone) and a breast. A breast refers to a human breast, in this disclosure, defined by a protruding region on the chest with a nipple.

Embodiments of the disclosed technology include a bra or other garment, with an area sized to cover two different (left and right) breasts of a woman. Both of the two different areas are connected to each other via a central region, as well as at least one of the straps which extend longitudinally around the person, and one strap over each shoulder. The straps over each shoulder have a triangular section which extends between the area sized to cover a breast and a shoulder, or at least partway from the area sized to cover a breast to the shoulder. This triangular section is disconnectable at a top side (relative to the body of a wearer) at the top apex of the triangle. By doing same, the triangle remains connected and is permanently attached. The term "permanently" is defined as sewn with a seam or continuous length of fabric that requires destruction of the seam or continuity of the fabric. The top apex of the triangle, however, can be removably connected by means of a removable connector.

When the top apex of the triangle is disconnected from the bra strap (a strap extending over the shoulder of the wearer), the bra strap remains intact and continues to hold a cup of the bra in place over at least part of the breast, as well as at least the nipple thereof. However, access is granted to a clavicle port by doing same. That is, the triangle falls in the direction from the shoulder to the navel (e.g. "down") from the apex, leaving the triangle attached at its lowest two vertices.

The bra itself has at least two layers which cover part or all of each breast—1) an inner cup or fabric layer, and 2) an outer fabric layer. The triangle described above is part of the outer layer and/or is fixedly or unitarily connected thereto. As such, when the triangle is disconnected from its removable connection to a bra strap, it falls away, leaving the inner cup or fabric layer exposed to the outside. It is this inner cup or fabric which continues to cover an area of the breast below the nipple, the nipple itself, and/or at least a part of the breast area above the nipple. Therefore, the port below the clavicle is accessible, while the wearer retains a level of modesty and dignity by having the most sensitive part of her breast (the nipple) and other parts thereof remain covered.

Figure 1:
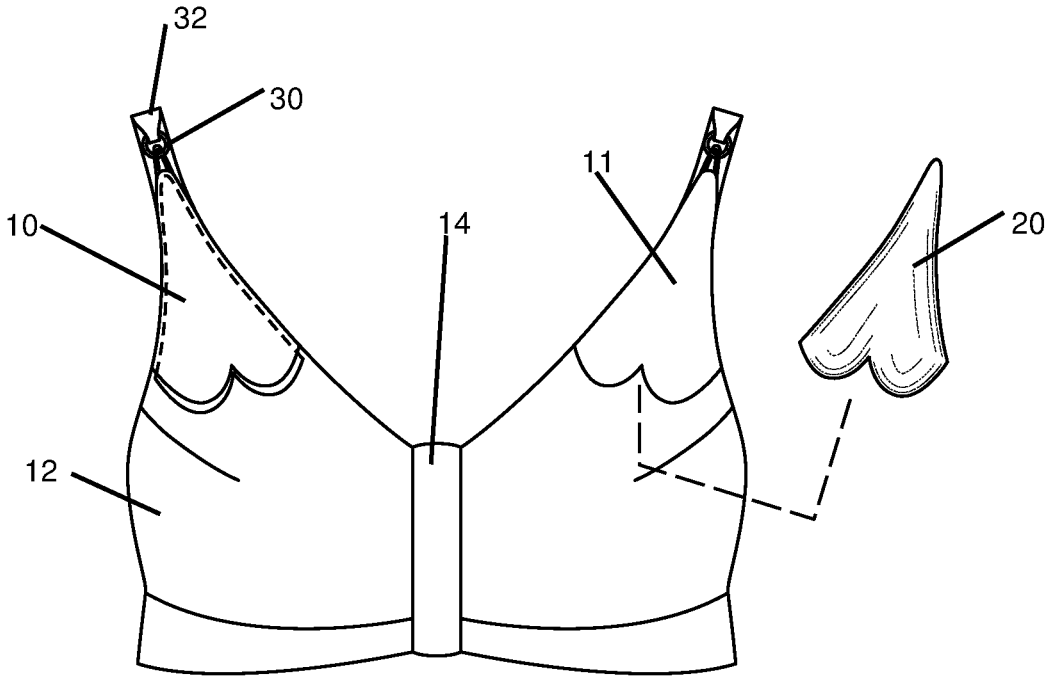
FIG. 1 shows a front view of an undergarment with designated pouches and removable pillow, in an embodiment of the disclosed technology.

FIG. 1 shows a front view of an undergarment with designated pouches and removable pillow, in an embodiment of the disclosed technology. Here the bra is shown with a central region 14 bisecting a left and right side with an outer layer 12. For purposes of this disclosure, "left" and "right" are from the perspective of the viewer, though the sides are interchangeable. The method/device can have a line of symmetry at the mid-region 14. A triangular attachment region 10 and 11 on one or both sides has a pillow 20 there-in (designated by the dotted lines in the triangular attachment region 10). Each triangular attachment region is disconnectable at the top by disconnecting a mechanical attachment 30 from a strap 32 or the like. That is, the triangular regions 10 and 11 are removably connectable at an apex or top region and fixedly connected or integrally sewn with the rest of a bra 12 at lower sides. The lower sides, as shown, can have two bumps of a top of a heart. The heart can be any shape or configuration, in addition to the particular heart shown. A "heart" for purposes of this disclosure is defined as having a narrowing apex (a point or narrowest region) which becomes wider on either side, meeting at a top side, the top side having two convex outer regions with a concave point between the two convex outer regions.

The pillow 20 fits within the triangular region 11 of the undergarment, pulled out from the bottom of the triangular region or side. A slit, which can be closable with a securing mechanism, such as a hook and loop fastener, a zipper, buttons, flap, or static friction, can be used to secure such an opening. This pillow can be placed in the undergarment or taken out for comfort during a surgical procedure.

Figure 2:
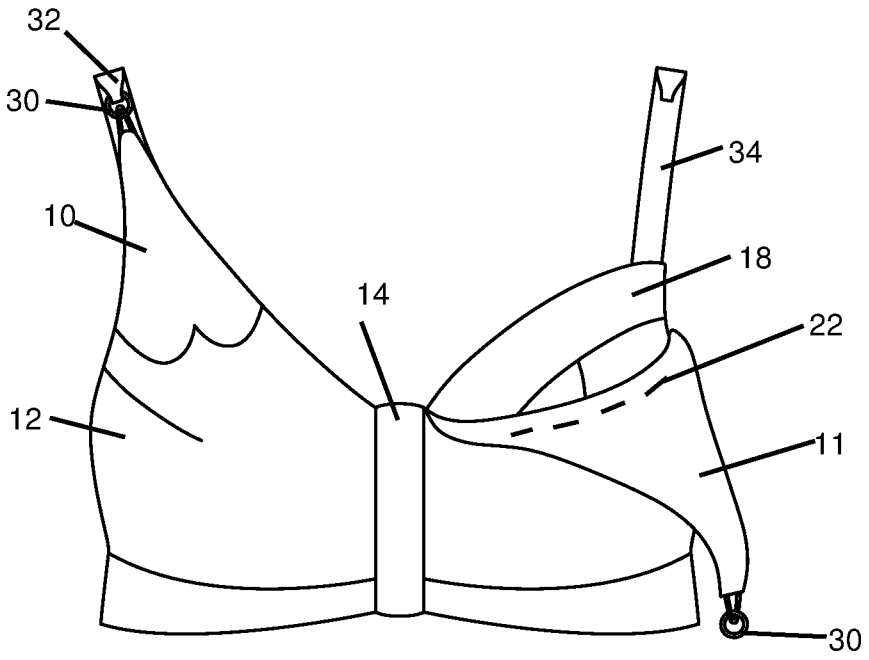
FIG. 2 shows a front view of an undergarment, with an outer layer disconnected at a top portion thereof, in an embodiment of the disclosed technology.

FIG. 2 shows a front view of an undergarment, with an outer layer disconnected at a top portion thereof, in an embodiment of the disclosed technology. Here, one of the triangular regions 11 or flaps is shown disconnected from its top side at the pinnacle, by way of disconnecting the fastener 30 from the strap 34. In this manner, the outer layer of the undergarment falls from the rest of the undergarment, covering an area between a breast and shoulder which is not covered by the strap, revealing a port or region of the skin. A surgical procedure can now take place at the exposed skin region, while inner layer cups 18 of the undergarment keep a breast or breasts partially and/or mostly covered. "Cups," for purposes of this disclosure are defined as an area of an undergarment designed and/or sized to fit over a nipple and/or breast. The breast (or breasts) continues to be supported by the undergarment and, more specifically, by inner layer 18, which is frictionally held against the body and/or held up by a strap such as strap 34.

Referring now specifically to the triangular region 11, this is an outer layer of the undergarment which covers the inner layer 18 when attached to the strap 34 (See FIG. 1). In the unattached state (unattached at the top side, as the bottom side is fixedly attached), one can see a fastening mechanism 22, such as buttons, stitching on the underside of hook and loop fastener, or fabric which tucks into other fabric. This fastening mechanism can, alternatively, or in addition, be along one of the elongated sides of the triangular region (one of the equal sides of what is generally an isosceles triangle, in embodiments of the disclosed technology).

Figure 3:
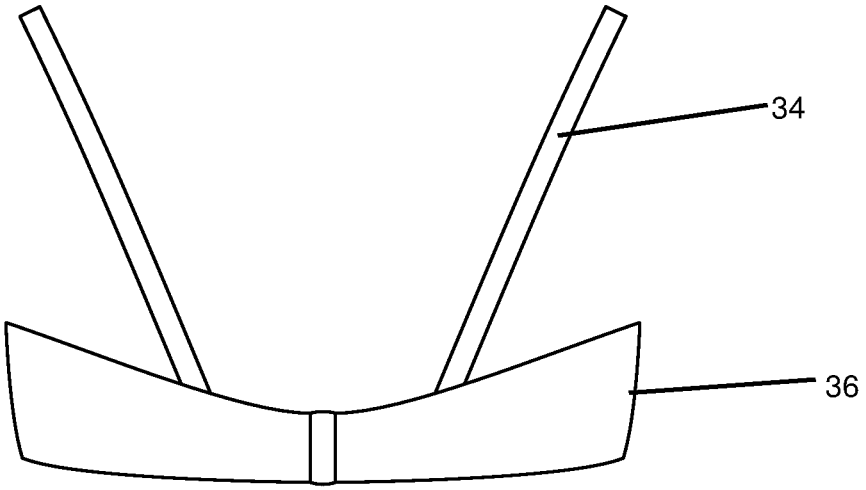
FIG. 3 shows a back view of an undergarment of an embodiment of the disclosed technology.

FIG. 3 shows a back view of an undergarment, of an embodiment of the disclosed technology. The strap 34, in embodiments of the disclosed technology, extends from where the top of the triangular piece 10 or 11 attaches to the strap 34 around the back side of a body, and then to the back portion 36 of the undergarment. The strap 34 thus supports the breast regions of the bra and the breasts by the shoulders of the wearer. The back portion 36 joins with the breast support regions 12 of the undergarment, as shown in the next figure.

Figure 4:
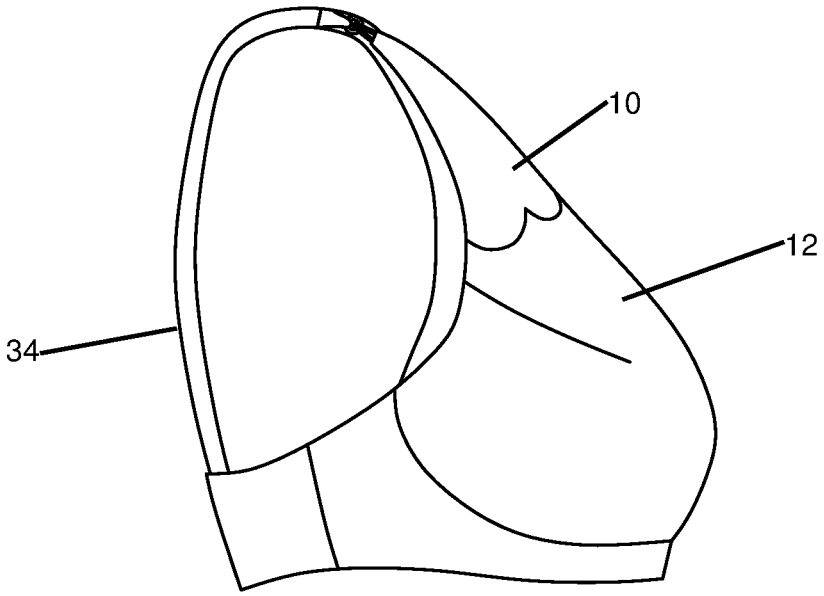
FIG. 4 shows a side view of an undergarment of an embodiment of the disclosed technology.

FIG. 4 shows a side view of an undergarment of an embodiment of the disclosed technology. Here, the triangular region 10 is shown integrally formed with the breast supporting region 12, which, in turn, further connects to a rear or back region 36 of the undergarment. The strap 34 connects to an upper narrowest region of the triangular region 10. The triangular region, seen from this view, has a top side with a fastener or connector, which connects to the strap 34, and bottom side, which forms an integral piece with the rest of the outer layer 12 of the bra. As such, the triangular region 10 covers a portion of the front of the body between the shoulder and breast (the "clavicle") where a port is inserted during surgery.

Figure 5:
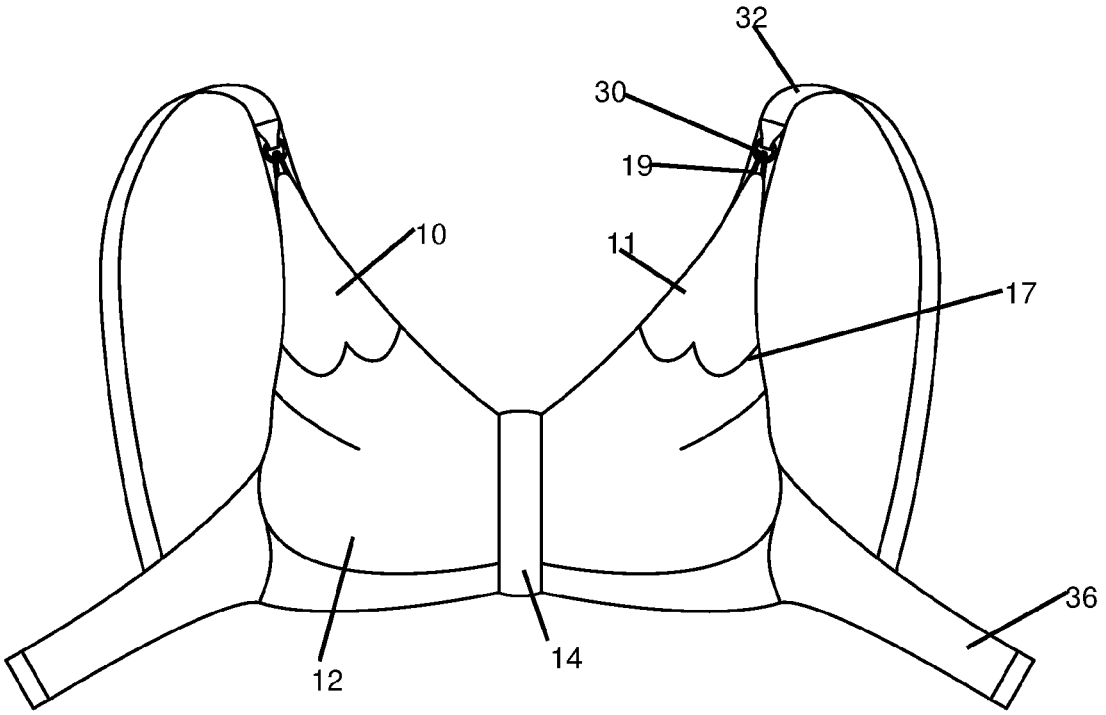
FIG. 5 shows a side view of an undergarment of an embodiment of the disclosed technology, with fully connected outer layers.

FIG. 5 shows a side view of an undergarment of an embodiment of the disclosed technology, with fully connected outer layers. In this embodiment, the bra strap 32 connects via a ring 30, which further connects to threads 19, which form an integral part of the triangular region 11. The triangular region 11 is heart-shaped, in that the bottom side 17 has two convex portions with a sharp concave point there-between forming a heart shape. A pouch area within this triangular region 11 can further be in a triangular or heart shape and can hold the heart-shaped pillow shown in FIG. 1. The triangular or heart-shaped regions 10 and 11 each respectively are formed from the same continuous material and/or are permanently sewn to the outer layer 12 of the bra region which covers the breasts. The lower strap 36 can be used to connect to itself around the torso of the wearer.

Figure 6:
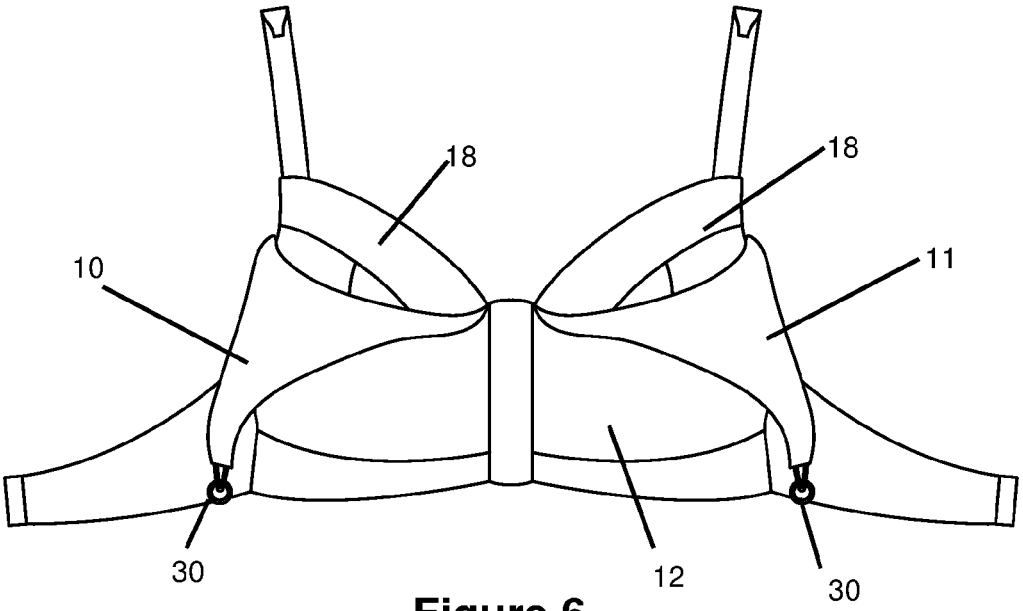
FIG. 6 shows a side view of an undergarment of an embodiment of the disclosed technology, with disconnected outer layers at a top side.

FIG. 6 shows a side view of an undergarment of an embodiment of the disclosed technology, with disconnected outer layers at a top side. Here, note that the triangular regions 10 and 11 are disconnected from the bra straps at their top fasteners 30. This reveals the inner layer 18 of the undergarments supporting the breasts, which are fixedly connected or sewn together, at least at bottom portions thereof, with the outer layer 12 of the garment. Note that the area of the skin of the wearer which was covered by the triangular regions 10 and 11 in FIG. 5, but which is not covered by the inner layers 18, is now revealed.

Further, in embodiments, no metal is used. Instead, the connectors and removable connectors can be made of plastic to avoid interfering with, or causing harm to, the body or medical equipment, as might occur when such medical equipment is used. Further, whenever the term "and/or" is used, this refers to any one of: a) both items separated by the term, b) the first item, and c) the second item.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described hereinabove are also contemplated and within the scope of the invention.

The invention claimed is:

1. A bra, comprising:

an inner layer with cups;

an outer layer having at least a lower side fixedly attached to said inner layer, and an upper side, opposite said lower side, removably attached to a strap;

a pocket disposed within said outer layer having an opening on a side facing said inner layer, said pocket being heart-shaped, heart-shaped being defined as having a narrowing apex, said apex being a point or narrowest region, which becomes wider on either side, meeting at a top side, said top side having two convex outer regions with a concave point between the two convex outer regions;

wherein a vertex of said heart-shaped pocket faces towards said upper side, and said two convex regions thereof face towards said lower side.

2. The bra of claim 1, wherein said pocket comprises there-within a heart-shaped pillow.

3. The bra of claim 2, wherein said heart-shaped pillow is oriented such that said two convex regions thereof face towards said lower side.

4. The bra of claim 1, wherein said upper side of said outer layer is substantially triangle-shaped and at least a majority of said pocket is within said triangle-shaped area.

5. The bra of claim 4, wherein said outer layer is fixedly attached to said inner layer along edges of two convex regions of said pocket.

6. The bra of claim 1, wherein said cups are adapted to cover breasts, and said outer layer is adapted to extend partially between an area from said breasts to a shoulder.

7. A bra and pillow kit, comprising:

a breast region adapted to cover breasts and a strap supporting said breast region, said strap extending over a shoulder;

an outer layer fixedly attached to said breast region and removably attached to said strap;

a removable pillow within said outer layer;

wherein said outer layer comprises an opening into a portal on a side of said outer layer which faces towards said strap.

8. The bra and pillow kit of claim 7, wherein said outer layer is fixedly attached to said breast region below a pocket housed within said outer layer and said outer layer is free from attachment to said inner layer at a region corresponding to said pocket.

9. A bra and pillow kit, comprising:

a breast region adapted to cover breasts and a strap supporting said breast region, said strap extending over a shoulder;

an outer layer fixedly attached to said breast region and removably attached to said strap;

a removable pillow within said outer layer;

wherein said outer layer is fixedly attached to said breast region below a pocket housed within said outer layer and said outer layer is free from attachment to said inner layer at a region corresponding to said pocket; and wherein a delineation between said pocket and an edge of said fixedly attached connection between said outer layer and said breast region is defined by two convex bumps, with a sharp vertex situated between each of said two convex bumps.

10. The bra and pillow of claim 7, wherein said portal extends most of a length of a portion of said outer layer which is free from attachment to said breast region.

11. The bra and pillow of claim 7, wherein said portal opens into a pocket sized to fit said pillow.

12. A method of using said bra and pillow kit of claim 11, comprising the steps of:

donning said bra with said pillow in said pocket;

disconnecting said outer layer from said bra strap while keeping said outer layer connected to said breast region;

removing said pillow from said pocket;

applying pressure to said pillow.

13. The bra and pillow of claim 8, wherein said pocket is widest near said breast region and narrows away from said breast region when said outer layer is connected to said strap.

* * * * *